US007527161B2

(12) United States Patent
Rodriguez et al.

(10) Patent No.: US 7,527,161 B2
(45) Date of Patent: May 5, 2009

(54) CAP CLOSURE

(75) Inventors: Jack Rodriguez, Bernardsville, NJ (US); John T. Glaser, Columbia, MD (US)

(73) Assignee: Fisher Scientific Company L.L.C., Hampton, NH (US)

( * ) Notice: Subject to any disclaimer, the term of this patent is extended or adjusted under 35 U.S.C. 154(b) by 886 days.

(21) Appl. No.: 11/001,279

(22) Filed: Dec. 1, 2004

(65) Prior Publication Data

US 2006/0113272 A1 Jun. 1, 2006

(51) Int. Cl.
*B65D 41/32* (2006.01)
*B65D 41/34* (2006.01)

(52) U.S. Cl. ..... 215/252; 215/258; 215/329; 215/901

(58) Field of Classification Search ..... 215/252, 215/253, 258, 329, 901
See application file for complete search history.

(56) References Cited

U.S. PATENT DOCUMENTS 4,493,427 A * 1/1985 Wolkonsky ..... 215/230
4,503,986 A 3/1985 Nixdorff et al.
4,511,053 A 4/1985 Brandes et al.
4,643,321 A 2/1987 Gach
4,679,696 A 7/1987 Bonnenfant et al.
4,700,859 A 10/1987 Gregory
4,805,791 A 2/1989 Begley
5,076,453 A * 12/1991 Odet ..... 215/252
5,715,959 A * 2/1998 Pfefferkorn et al. ..... 215/252
5,813,553 A * 9/1998 Herr et al. ..... 215/252
6,085,921 A 7/2000 Brown
6,439,411 B1 * 8/2002 Schwarz ..... 215/252
6,942,114 B2 * 9/2005 Nishida ..... 215/252
7,059,485 B1 * 6/2006 Reidenbach ..... 215/252
2001/0030164 A1 * 10/2001 Corvaglia ..... 215/252
2002/0166836 A1 * 11/2002 Moretti ..... 215/252

(Continued)

FOREIGN PATENT DOCUMENTS

DE 37 34 034 A1 5/1989

(Continued)

OTHER PUBLICATIONS

Four (4) color photographs of a third party cap closure believed by Applicants to be commercially available and used by an affiliate of the assignee prior to Dec. 1, 2004.

(Continued)

*Primary Examiner*—Anthony D Stashick
*Assistant Examiner*—Niki M Eloshway
(74) *Attorney, Agent, or Firm*—Wood, Herron & Evans, LLP

(57) ABSTRACT

The embodiments described herein illustrate a cap for a container comprising a cap body that includes an upper portion and a lower portion. The lower portion has an outer circumferential sidewall defining a ring-positioning member. The cap also has a ring that includes an outer member selectively engaging the ring-positioning member and an inner member disposed proximate an inside surface of the lower portion. The inner member has at least one tab extending inwardly and upwardly and terminating at a first edge. The inner member also has at least one finger member protruding inwardly from the inner member and terminating at a second edge above the first edge of the tab.

41 Claims, 9 Drawing Sheets

U.S. PATENT DOCUMENTS

| | | | | |
|---|---|---|---|---|
| 2004/0060891 | A1* | 4/2004 | Nishida | 215/252 |
| 2004/0232100 | A1* | 11/2004 | Reidenbach | 215/252 |
| 2005/0199573 | A1* | 9/2005 | Last | 215/252 |
| 2006/0175281 | A1* | 8/2006 | Ekkert | 215/252 |

FOREIGN PATENT DOCUMENTS

| | | | |
|---|---|---|---|
| DE | 3734034 | A1 | 5/1989 |
| DE | 20211828 | U1 | 11/2002 |
| DE | 202 11 828 | U1 | 1/2003 |
| DE | 10155578 | A1 | 5/2003 |

OTHER PUBLICATIONS

European Patent Office, Patent Cooperation Treaty, International Search Report and Written Opinion of the International Searching Authority, Dated Apr. 24, 2006, 11 pages.

* cited by examiner

CAP CLOSURE

FIELD OF THE INVENTION

The present invention relates to a closure cap for a container, and in particular to a ring structure for engagement with a container neck of the container.

BACKGROUND

A number of closure caps are provided with a tamper-evident band, which is secured to the closure cap. The tamper-evident band gives an indication that the container has been initially opened or tampering has occurred. Such closure caps usually involve elaborately molded one or multiple piece caps, which frequently require a special container. The purpose in using such a closure cap is to insure customers that the container package has remained closed in its originally filled condition prior to purchase.

These closure caps with the tamper-evident band, while useful in certain applications, have certain disadvantages in many applications including products packaged in glass or plastic containers, and more particularly hazardous products packaged in glass or plastic containers.

First, closure caps known in the art are sometimes known to "back off" or untwist from harmonic vibrations caused by road conditions or other non-standard forms of movement that can take place during transport. If sufficient "back off" takes place, the closure cap may become at least partially unsealed from its mating container. It would therefore be desirable to have a container cap with a structure that would prevent the cap from "backing off" from the container during transport.

Second, typical tamper indicating closure caps permit a tamper indicating structure in the form of a ring to slide freely along the container neck once the container has been initially opened. This provides a potential distraction to the user when pouring the contents of the container. By securing the closure cap structure to the bottle neck, the user is able to concentrate on pouring the liquid while minimizing potential distraction from the ring.

Third, the tamper indicating structure is often disposed inside the container cap and not visible to the user until the container is initially opened. It would be desirable to provide a ring-shaped structure that can be molded separately from the closure cap and disposed on both the inside of the cap for securement with the bottle neck and the outside of the closure cap for general indication of the container contents by color.

Moreover, it would be desirable to have a closure cap with the above mentioned advantages while providing the user with a visual and audible indication that the container has not been previously opened or subject to tampering.

In short, the purpose in using such a closure as described above includes the desirability to insure users that the container has remained closed in its originally filled condition prior to purchase, safeguard against contamination by a leaking container, and allow visual inspection of the general contents of the containers by providing a color coded structure on the cap indicating the general contents of the container.

BRIEF SUMMARY

The embodiments described herein illustrate a cap for a container comprising a cap body that includes an upper portion and a lower portion. The lower portion has an outer circumferential sidewall defining a ring-positioning member. The cap also has a ring that includes an outer member selectively engaging the ring-positioning member and an inner member disposed proximate an inside surface of the lower portion. The inner member has at least one tab extending inwardly and upwardly and terminating at a first edge. The inner member also has at least one finger member protruding inwardly from the inner member and terminating at a second edge above the first edge of the tab.

Various aspects and advantages of this invention will become apparent to those skilled in the art from the following detailed description of the embodiments described herein, when read in light of the accompanying drawings.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Figure 6:
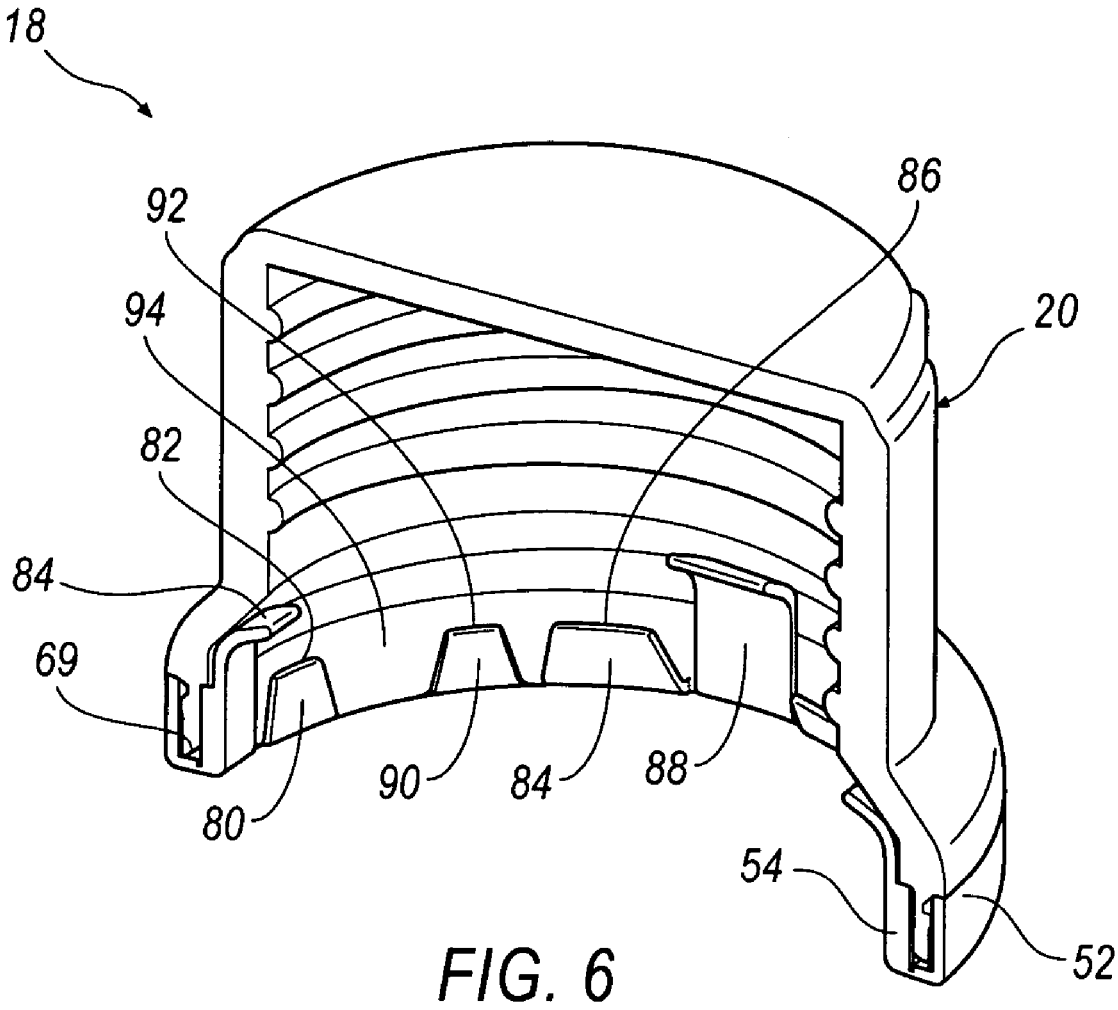
FIG. 6 is a perspective section view along section A-A in FIG. 1 of an assembly of a closure ring and closure cap according to a first embodiment of the invention showing tabs of different circumferential extents.
Figure 7:
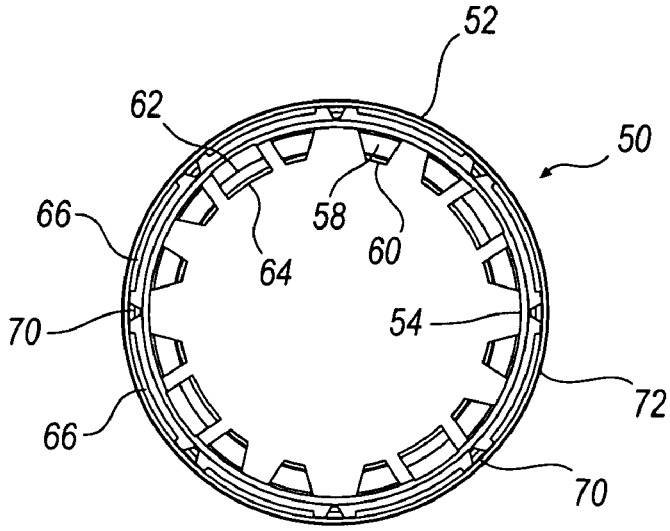
FIG. 7 is a top plan view of a closure ring according to a second embodiment of the invention showing tabs of equal circumferential extent disposed symmetrically around the inner member.
Figure 8:
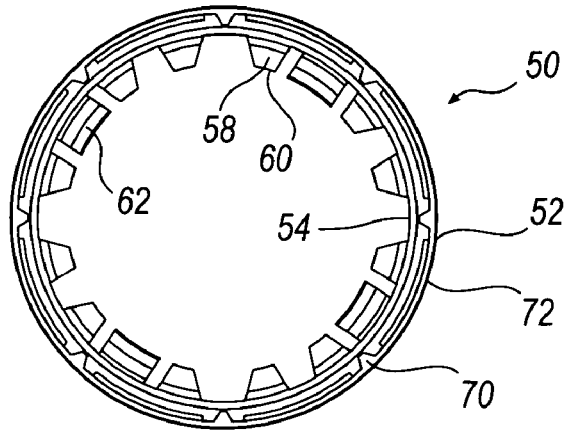
FIG. 8 is a bottom plan view of the closure ring of FIG. 7.
Figure 12:
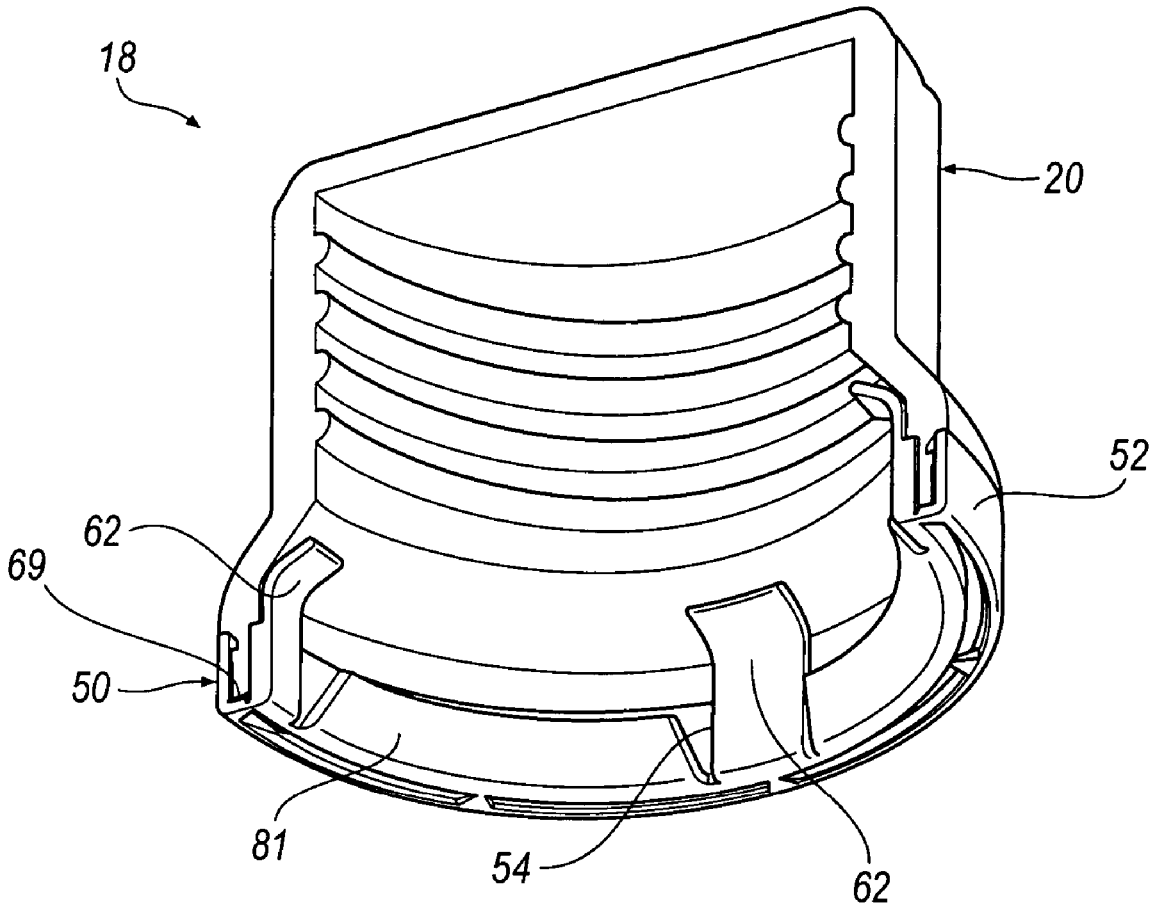
FIG. 12 is a perspective section view along section A-A in FIG. 1 of an assembly of a closure ring and closure cap according to a third embodiment of the invention showing one tab disposed circumferentially between the finger members.
Figure 13:
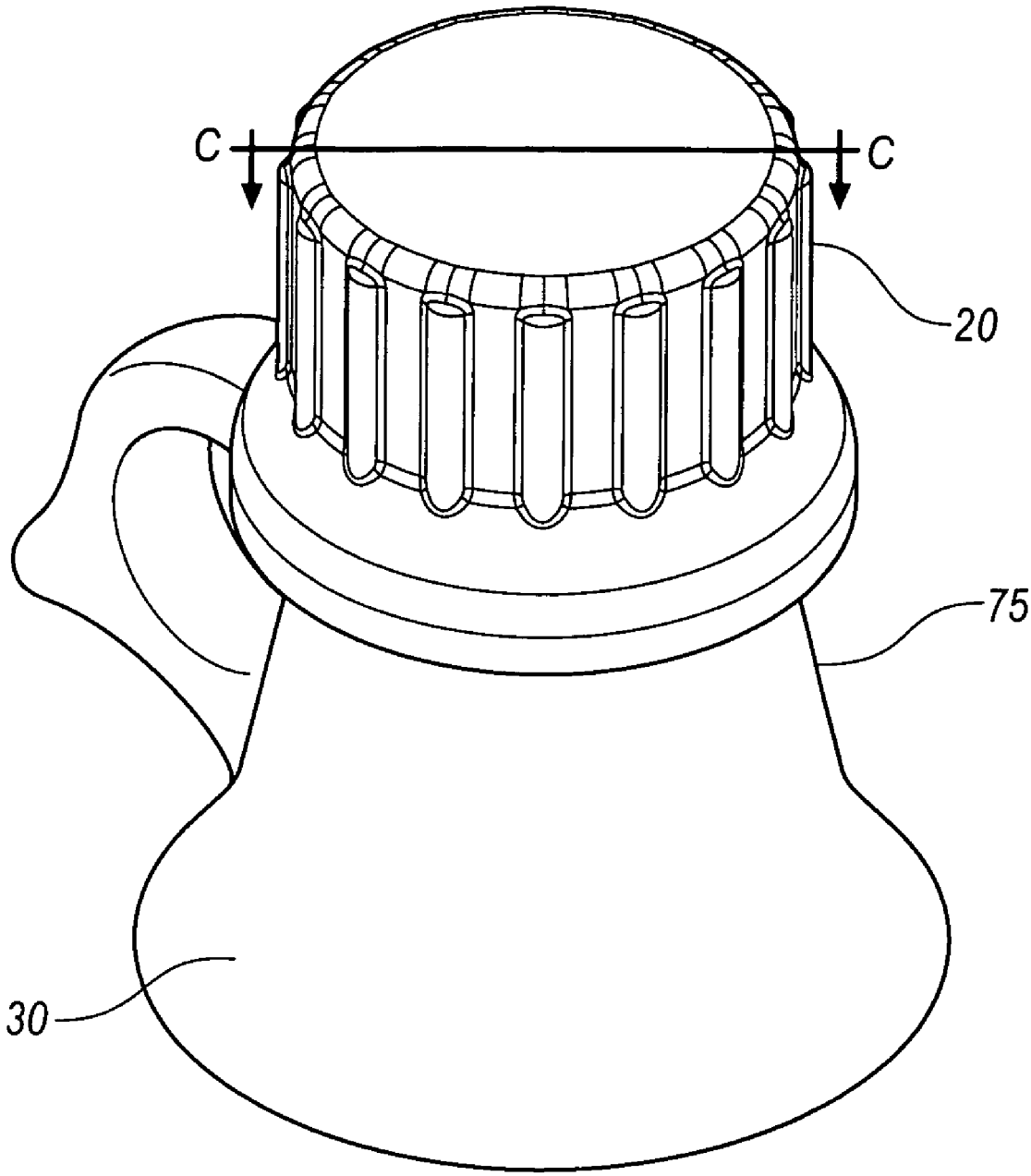
FIG. 13 is a perspective top view of an assembly of a closure cap and a closure ring according to an embodiment of the invention showing the assembly secured to a container.

A closure cap assembly 18 is illustrated with reference to a cap body 20 as illustrated in FIGS. 1 to 5 and a closure ring 50 as illustrated in FIGS. 7 to 10. Closure cap assembly 18 including a cap body 20 and a closure ring 50 is shown in an assembled orientation in the embodiments of FIGS. 6 and 12. The use of closure cap assembly 18 in relationship to a container 30 is illustrated with respect to FIGS. 13 to 16. FIG. 6 illustrates a first embodiment of the cap assembly 18 showing the cap body 20 and the closure ring 50 having tabs of different circumferential extents. Other embodiments of the closure ring 50 are contemplated including a second embodiment illustrated in FIGS. 7-11 showing tabs 58 of equal circumferential extent disposed symmetrically around the inner member 54 and a third embodiment illustrated in FIG. 12 showing a tab 81 disposed circumferentially between two finger members 62.

Figure 1:
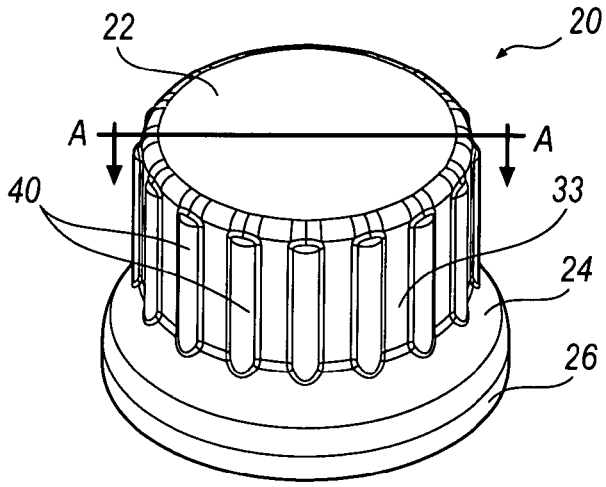
FIG. 1 is a top perspective view of a closure cap according to an embodiment of the invention.
Figure 2:
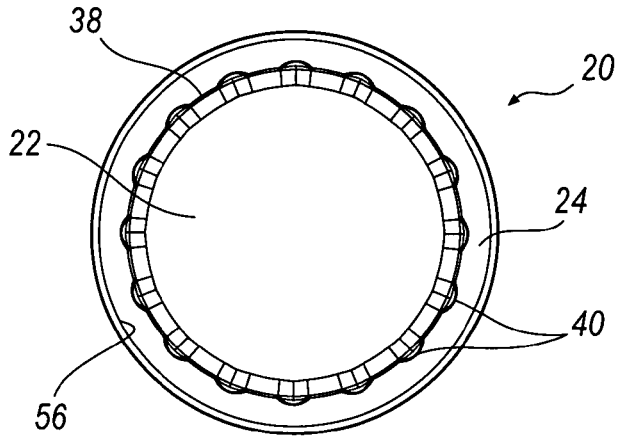
FIG. 2 is a top plan view of the closure cap of FIG. 1.
Figure 3:
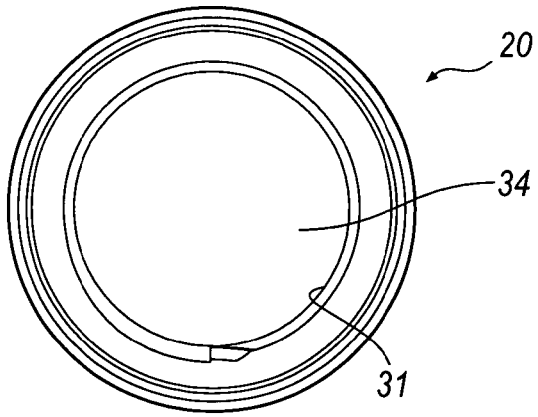
FIG. 3 is a bottom plan view of the closure cap of FIG. 1.
Figure 15:
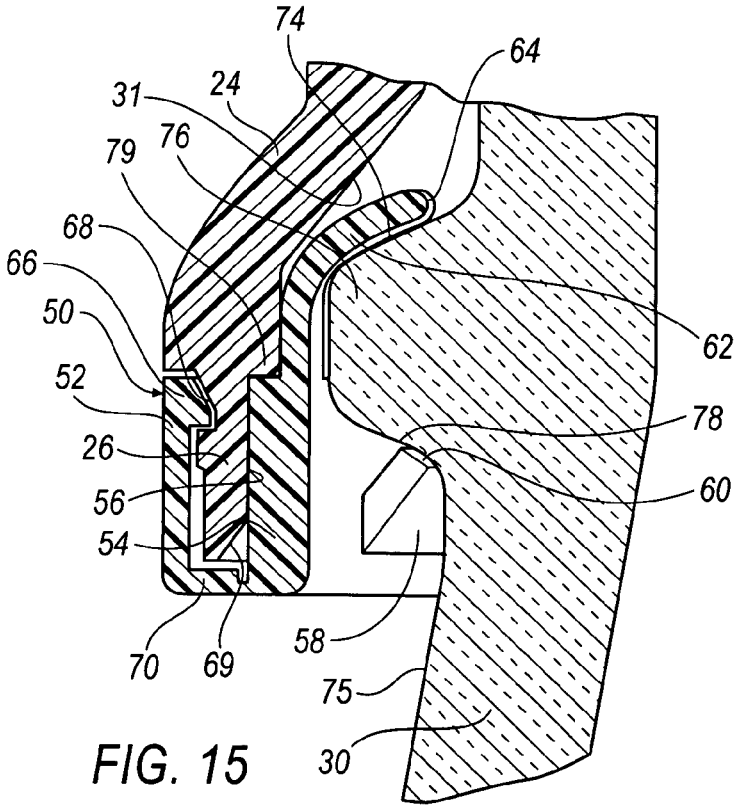
FIG. 15 is an exploded side section of the assembly of the closure ring and the closure cap of FIG. 14.

The cap body 20 forms the first component of the closure cap assembly 18. As best illustrated in FIGS. 1 to 6, it includes an upper portion 22 and a lower portion 24. The lower portion 24 has an outer circumferential sidewall terminating at a ring-positioning member 26. The lower portion 24 is shown in FIG. 1 as an integrally molded skirt extending radially outwardly of and away from the upper portion 22. The lower portion 24 includes a ridge 79 disposed proximate an inner circumferential surface 31 of the cap body 20 and is adapted to selectively engage an inner member 54 of a ring 50 as shown in FIG. 15, described in more detail below.

Figure 14:
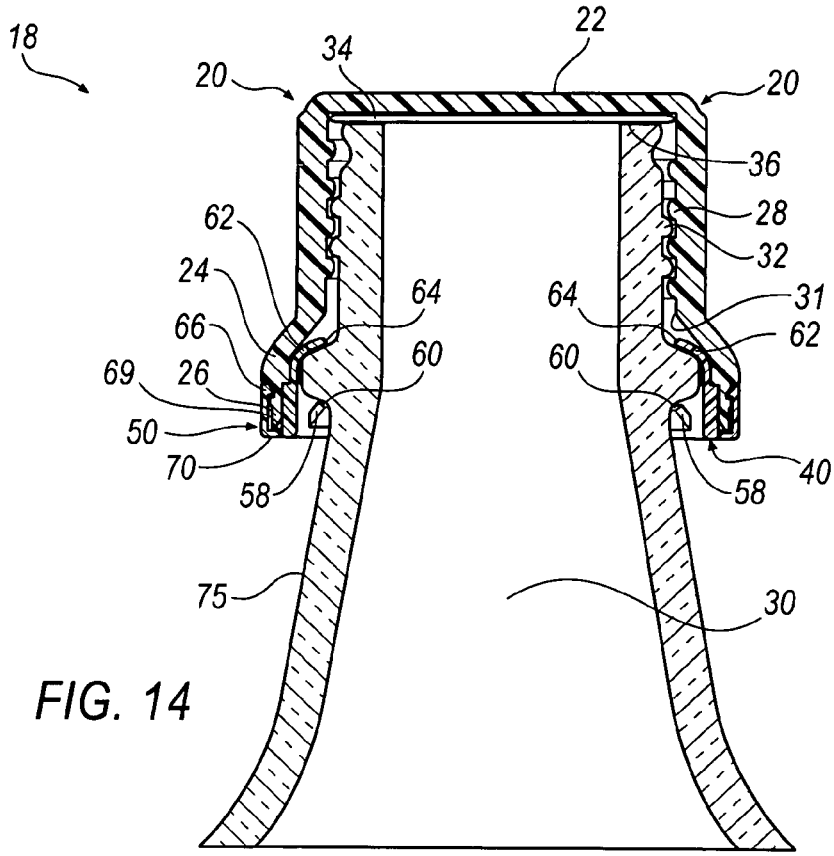
FIG. 14 is a side section along section C-C in FIG. 13 of an assembly of a closure ring and a closure cap according to an embodiment of the invention showing the assembly secured to a neck of a container after the assembly has been screwed onto the neck of the container.

A securing structure 28 is also disposed on the inner circumferential surface 31 of the cap body 20 and is typically associated with the upper portion 22, although it may also include at least a portion of the lower portion 24. The securing structure 28 is illustrated with threads such as Standard 434 and 439 threads or the like. Any threads or locking structure, however, may be used. The securing structure 28 engages a corresponding structure on a container 30 as shown in FIG. 14. A standard thread 32 on the container 30 is illustrated engaging the securing structure 28 of the cap body 20.

A liner 34 is disposed on the underside of the upper portion 22 of the cap body 20 forming a seal with a container rim 36 when cap assembly 18 is properly sealed to its mating container 30. The liner 34 may be made from polyethylene, polypropylene, or an appropriate fluroropolymer (such as ETFE and PTFE) or other polymeric material with similar elasticity selected based on the anticipated contents of the container 30 to be capped. The liner 34 provides a compression layer forming a seal to protect the cap assembly 18 and container 30 from the contents of the container 30 as shown in FIG. 14. A cut liner is illustrated; however, other known gaskets or molded plastic liners may be used.

Figure 4:
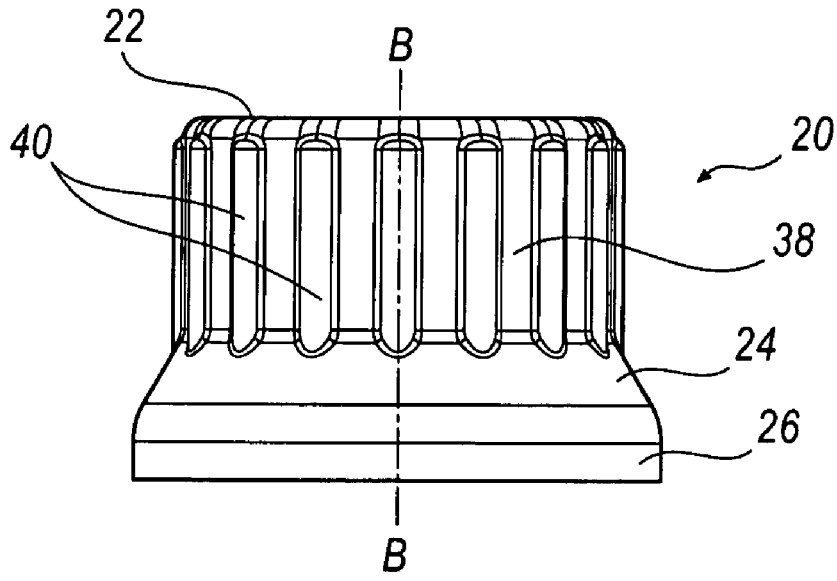
FIG. 4 is a side view of the closure cap of FIG. 1.
Figure 5:
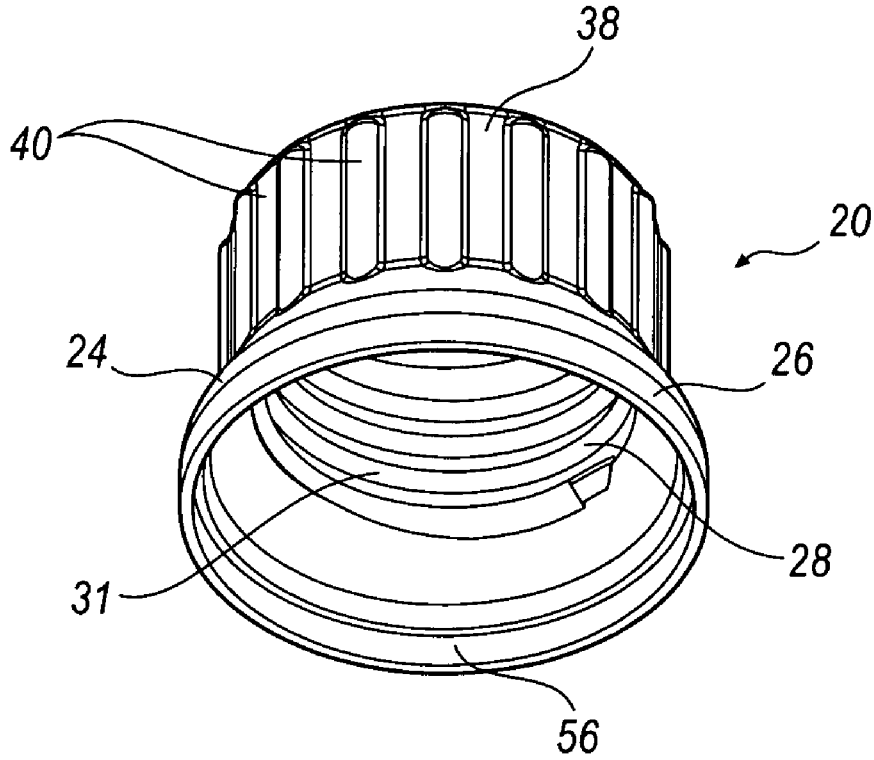
FIG. 5 is a bottom perspective view of the closure cap of FIG. 1.

An outer circumferential surface 38 of the upper portion 22 includes a plurality of ribs 40 disposed parallel a longitudinal axis B-B as shown in FIG. 4. The ribs 40 provide a gripping structure so that a generally consistent torque may be applied to cap body 20 when closing or opening container 30. Regulatory requirements outline a narrow acceptable torque range. The ribs 40 allow a torque wrench to "bite" the cap body 20 and exert a consistent amount of torque during assembly. The ribs 40 provide a proper fit for a torque wrench when testing the torque applied to the cap body 20 during assembly by having an equal arrangement of ribs. It is contemplated that any structure for gripping the cap body 20 may be used including deeper ribs, various shaped indentations, various shaped protrusions from the outer circumferential surface 38, or an otherwise appropriately textured surface. The outer circumferential surface 38 of the cap body 20 may also be formed in a different shape including a polygon having a plurality of sides (not shown).

The cap body 20 may be formed from a rigid or semi-rigid polymeric material such as polyimide resin, polypropylene, polyamide (nylon) or the like or a metal such as aluminum. While it may be formed using a variety of approaches, preferably it is molded.

Closure ring 50 is the second component of sealing cap assembly 18. An embodiment of the ring itself is illustrated in FIGS. 7 through 11, and in relationship to sealing cap 20 in FIGS. 6, 12, 14 and 15. FIG. 6 illustrates a first embodiment of the cap assembly 18 showing the cap body 20 and the closure ring 50 having tabs of different circumferential extents. Other embodiments of the closure ring 50 are contemplated including a second embodiment illustrated in FIGS. 7-11 showing tabs 58 of equal circumferential extent disposed symmetrically around the inner member 54 and a third embodiment illustrated in FIG. 12 showing a tab 81 disposed circumferentially between two finger members 62. The closure ring 50 may be formed from a rigid material which can flex reversibly, such as polypropylene or polyethylene or other similar polymeric material, with polypropylene being preferred. It is also preferably molded, although it also may be formed using a variety of approaches.

The closure ring 50 includes an outer member 52 adapted for selectively engaging the ring-positioning member 26 of the cap body 20, and an inner member 54 disposed proximate an inner surface 56 of the lower portion 24 of the cap body as shown in FIG. 15. A plurality of frangible connections 70 selectively secure outer member 52 with inner member 54 prior to an initial opening of a container 30.

The inner member 54 has at least one tab 58 extending radially inwardly and upwardly and terminating at an outer edge 60. At least one finger member 62 protrudes radially inwardly from the inner member 54 and terminates at an outer edge 64 above the outer edge 60 of the tab 58 as shown in FIG. 15. While tabs 58 are shown terminating below the upper edge 61 of outer member 52 in the illustrated embodiment (FIG. 9), in some embodiments they may extend above the edge so long as they are below edge 64 of finger members 62. In other words, tabs 58 of the embodiment illustrated in FIG. 9 do not extend above upper edge 61 and therefore are not seen in the view of FIG. 9; in other embodiments (not shown) they may extend above upper edge 61, but will still be below edge 64 of finger members 62.

The outer member 52 is secured into position on the ring-positioning member 26 of cap body 20 by having radially inwardly projecting protrusions 66 of the outer member 52 engage a groove 68 of the sealing cap lower portion 24 (FIG. 15). Protrusions 66 are disposed circumferentially around outer member 52 (FIG. 7), and are sized to provide a firm engagement while still being able to flex in an appropriate manner to engage groove 68 of lower portion 24. The outer member 52 may be secured into position by other means including the use of an adhesive such as glue, sonic welding, or the interchange of the tab and groove between the outer member 52 of the ring 50 and ring-positioning member 26.

As discussed in greater detail below, the outer member 52 will remain secured to the cap body 20 after the outer member 52 is separated from the inner member 54 when the cap body 20 is removed from the container 30. A chamfer 69 of the ring positioning member 26 is adapted to provide unimpeded recapping of the cap body 20 by insuring that the ring-positioning member 26 of the cap body 20 will not interfere with the detached inner member 54 as shown in FIG. 15.

As mentioned above, inner member 54 and outer member 52 are selectively connected using a plurality of frangible connections 70 prior to initially opening a container 30. Each frangible connection 70 is shown illustrated in the form of a triangular tab secured to the outer member 52 having an opposing apex of the frangible connection 70 connected to the inner member 54. The plurality of frangible connections 70 are preferably symmetrically spaced along a circumferential edge 72 of the outer member 52. Using a triangular shape permits the frangible connections 70 to remain with the outer member 52 when separation occurs by having the base of the frangible connection disposed on the outer member 52 and the apex of the frangible connections 70 secured to the inner member 54. Locating the base of the frangible connections 70 on the outer member 52 permits a more efficient vertical separation by taking advantage of the ridged cap body 20. Each frangible connection 70 is broken generally simultaneously by a vertical separation of the inner member 54 from the outer member 52 exerting an equalized force on all frangible connections 70. When the frangible connection 70 is physically broken, it provides the user with an audible signal indicating that the container 30 has not previously been opened. The frangible connections 70 may have various other shapes including a circle, an oval, or a polygon. These shapes may be utilized when various tamper indicating methods are desired including having the frangible connections 70 in a more visually destroyed orientation.

Figure 16:
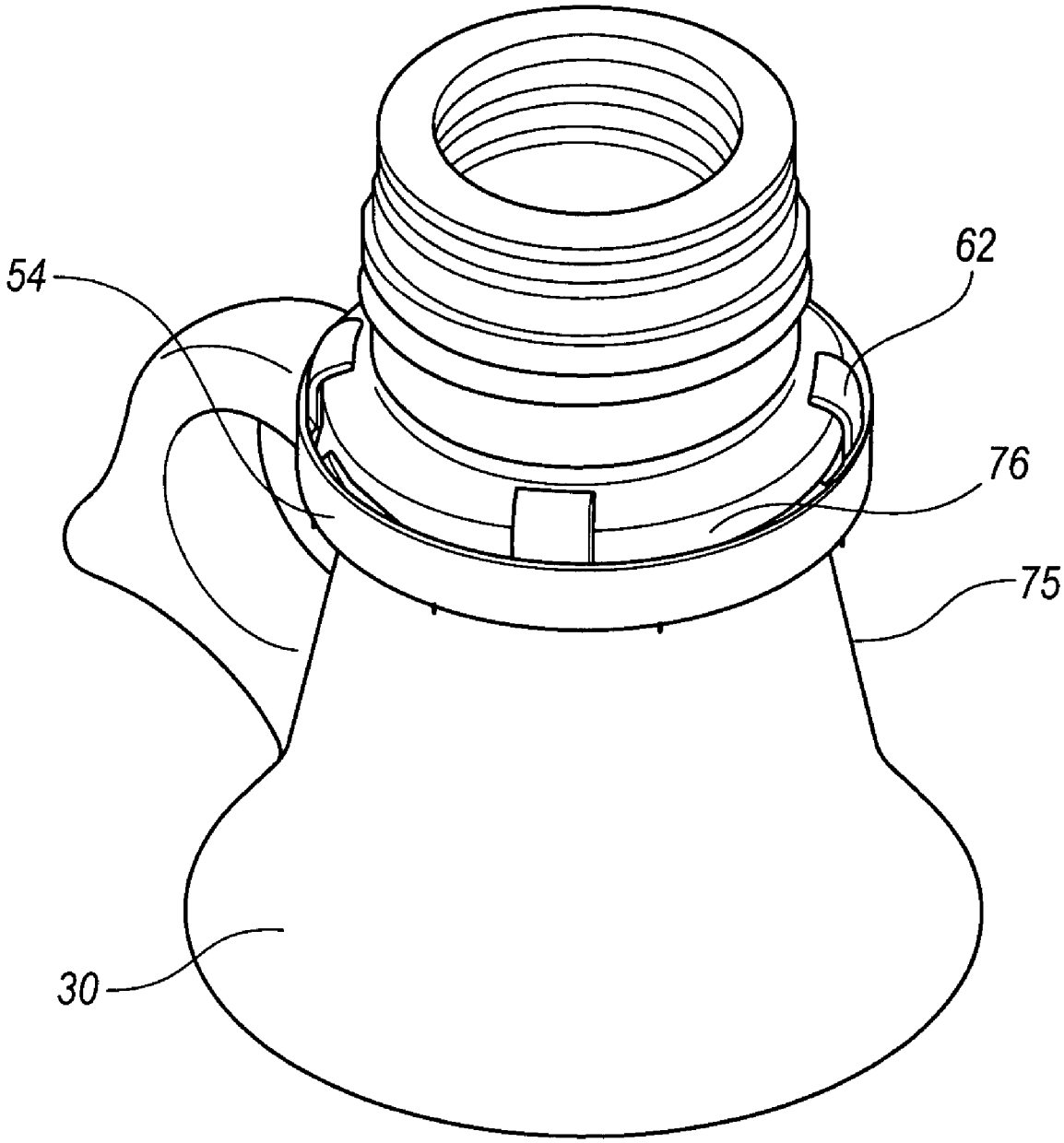
FIG. 16 is a perspective top view of an inner member of a closure ring and a container according to an embodiment of the invention showing the detached inner member of the closure ring in FIG. 14 after the closure cap has been screwed off and only the inner member remains.

The securement of ring 50 of sealing cap assembly 18 with respect to a container 30 is best illustrated in FIGS. 14 through 16. Inner member 54 as shown secured in place with respect to a transfer bead 76 formed on a container neck 75 of container 30 by the finger member 62 and the tab 58. More specifically, once closure ring 50 and cap body 20 are mated, assembly 18 is initially placed on the container 30. Using the mechanism defined by securement structure 28, it is moved in a downward direction. When standard threads are used for the securement structure 28, a clockwise rotation will move the cap in a downward direction and a counterclockwise rotation will move the cap in an upward direction. Tabs 58 are flexed over the transfer bead 76 until the finger members 62 rest on an upper surface 74 of the transfer bead 76 and the tabs 58 rest on a lower surface 78 of the transfer bead 76. Thus, transfer bead 76 is trapped between tabs 58 and finger members 62. In one embodiment, the pressure between the upper surface 74 of the transfer bead 76 by the finger member 62 and the lower surface 78 of the transfer bead 76 by the tab 58 secures the closure ring 50 from generally moving in a vertical direction and impedes the closure ring 50 from rotation around the transfer bead 76 of the container 30.

As the container 30 is moved around and vibrated during transport, the cap is sometimes known to "back off." If sufficient "back-off" takes place, the cap may become partially unsealed from its mating container 30. Therefore, edges 60 of tabs 58 apply a substantive force upon surface 78 to minimize the possibility of such "back-off". The tabs 58 include a sufficient length and circumferential extent to apply the necessary resisting force while still maintaining the appropriate connection between inner member 54 and outer member 52 by way of frangible connections 70.

Typically, fingers 62 rest on upper surface 74 of transfer bead 76. They prevent the closure ring 50 from moving substantially further in a downward direction. In some embodiments, a substantive force may be applied to minimize the possibility of over-torquing of the sealing cap 18 with respect to the container 30. However, in such a situation, tolerances will be particularly important. Typically, however, the liner 34 on the underside of the upper portion 22 of the cap body 20 is adapted to prevent the user from over-torquing the cap when the cap is tightened. This is accomplished when the container rim 36 engages the liner 34 during securement of the cap body 20. As shown in FIG. 15, a ridge 79 on the lower portion 24 of the cap body 20 is adapted to communicate with the inner member 54, stabilize the inner member 54, and minimize vertical force on the outer member 52.

In the illustrated embodiments of FIGS. 6-12, the inner member 54 is shown to have four upwardly and inwardly extending fingers 62 symmetrically spaced around the inner member 54. The closure ring 50 many include any number of finger members 62 depending on the amount of force required to hold the closure ring 50 in place. It is also contemplated that only an inwardly extension of the finger member 62 is necessary to make contact with the upper surface 74 of the transfer bead 76.

A plurality of tabs 58 are disposed circumferentially between two adjacent finger members 62 in most illustrated embodiments. In the first embodiment, there are three such tabs 80, 84 and 90 spaced somewhat unequally, as described further below with respect to the view of FIG. 6. In a second embodiment as shown in FIGS. 7-11, there are three such tabs spaced equally. In a third embodiment as shown in FIG. 12, a tab 81 is disposed circumferentially between two finger members 62.

It is also contemplated that the outer edge 60 of the tabs 58 may be formed with different circumferential extents as shown in FIG. 6. In a clockwise direction from a first finger member 84, a first tab 80 with a first top edge 82 is proximate the first finger member 84. In a counter clockwise direction from the second finger member 88, a second tab 84 with a second top edge 86 is proximate the second finger member 88. A third tab 90 with a third top edge 92 is proximate the second tab 84. The third top edge 92 is approximately equal to the first top edge 82 in circumferential length.

The pattern shown in FIG. 6 is generally more efficient at breaking the frangible connections 70 by allowing an even vertical force to be applied to the frangible connections 70 while also minimizing undesired twisting of the inner member 54 by providing more structural rigidity to the inner member. Specifically, the pattern shown in FIG. 6 in a first circumferential direction includes the generally larger tab 84, the first generally smaller tab 90, a space 94, and the second generally smaller tab 80. The frangible connection 70 is disposed between the finger member 62 and the generally larger tab 84. Another frangible connection is disposed between the first generally smaller tab 90 and the second generally smaller tab 80.

When certain hazardous chemicals are stored or mixed together, violent reactions may occur because the chemicals are unsuitable for mixing, or are incompatible. Classes of incompatible chemicals should be segregated from each other during storage, according to a hazard class.

The fact that the closure body 20 and the closure ring 50 are formed separately permits a further advantage of providing the closure ring 50 having different colors. In one such scheme, red is associated with flammable liquids, blue for especially toxic chemicals, yellow with oxidizing chemicals, white with corrosive chemicals and gray with general chemical storage. Other color schemes for groups of chemicals or other liquid products can be adopted for the closure ring 50, usually based on color schemes already used on product labels or other packaging within any particular field of use.

The closure ring 50 is visible enough to provide an efficient method of inspecting the hazard class of containers in a particular area without the additional time necessary to inspect each container label. The closure ring 50 also provides the user the ability to inspect the hazard class of a package of containers without the need to remove each container 30 and read each label since the color of the closure ring 50 is visible from the top of the container 30. Other colors may be used to further indicate the contents of the container 30 within a hazard class.

A second embodiment (not shown) of the cap body 20 is contemplated that includes molding the upper portion 22 of the cap body 20 without a skirt defining a lower portion 24.

The lower portion 24 would be very similarly to the upper portion 22 in size and shape. In other words, the outer surface of the cap body 20 would have generally the same radial extent at the upper portion 22 as the radial extent of the lower portion 24. A space for the inner member 54 would be defined by forming the upper portion 22 of the cap body 20 to permit contact with the threads 32 of the container 20 while providing the space required for the inner member 54. One way of achieving this would be to form the upper portion 22 of the cap body 20 with a thicker section of material.

An alternative embodiment for the mechanism defined by securement structure 28 includes having the cap assembly 18 move in a downward direction when the cap assembly 18 is turned in a counterclockwise direction and having the cap assembly 18 move in an upward direction when the cap assembly 18 is turned in a clockwise direction. The securement structure 28 may include a structure that allows the user to push the cap assembly 18 in a downward direction over the transfer bead 76 of the container 30 and twist for locking in either a clockwise direction or counterclockwise direction. It is also contemplated that the cap assembly 18 may be pushed in a downward direction over the transfer bead 76 of the container 30 and no securement structure is provided. The cap assembly 18 is unsecured by an upward motion by the user.

A method of separating the cap body 20 from the container 30 where the cap assembly 18 is in selective contact with the container neck 75 of the container 30 includes the steps described below. In a secured orientation, the outer member 52 of the closure ring 50 is in selective contact with the cap body 20 and the inner member 54 of the closure ring 50 is secured to the container neck 75. The inner member 54 has at least one tab 58 and at least one finger member 62 in selective contact with the container neck 75 in the secured orientation. The tab 58 extends inwardly and upwardly and terminates at the outer edge 60. The finger member 62 protrudes inwardly from the inner member 54 and terminates at an outer edge 64 above the outer edge 60 of the tab 58. The outer member 52 and the inner member 54 are connected by a frangible connection 70. The frangible connection 70 is disposed between the inner member 54 and the outer member 52.

Twisting the cap body 20 in a counterclockwise direction breaks the frangible connections 70 by a vertical motion of the cap body 20 when the cap body 20 moves upwardly along the threads and transmits an upward shear force on the closure ring 50. While the outer member 52 is conveyed upwardly (maintained by protrusion 66 in groove 68), the inner member 54 is arrested from upward movement by the engagement between tab 58 and finger member 62 against the transfer bead 76 discussed further below. The vertical force provides the frangible connections 70 to experience an upward shearing force, allowing the frangible connections 70 to break.

The method includes arresting the inner member 54 of the closure ring 50 from moving upwardly or downwardly on the container neck 75 of the container 30 by having finger member 62 and the tab 58 disposed between an upper surface 74 and a lower surface 78 of the transfer bead 76 respectively. When the frangible connection 70 are broken, the tab 58 prevents the inner member 54 from sliding up the container neck 75 while the finger members 62 prevent the inner member 54 from sliding down the container neck 75.

The method further includes arresting the inner member 54 of the closure ring 50 to the transfer bead 76 on the container neck 75 after the cap body 20 has been detached as shown in FIG. 16. The outer edge 60 of the tab 58 is in selective contact with the lower surface 78 of the transfer bead 76. The outer edge 64 of the finger member 62 is in selective contact with the upper surface 74 of the transfer bead 76.

The container 30 to be capped may be formed from glass or of various rigid polymeric materials or metals such as aluminum, steel, or the like. Exemplary polymeric materials for the container are polyethylene (LDPE or HDPE), polypropylene, fluoropolymers (e.g., ETFE) and fluorinated polyethylene. In one embodiment of the container, the container should include a securement structure on a neck with external screw threads (or other structure complementary to the securing structure 28 on inside surface 31) and have a transfer bead 76 or other structure that can engage the tabs 58 (and fingers 62, if present) of the inner member 54. Where there is a transfer bead 76, it is preferable that its exterior side and upper surface 74 be arcuate and its lower surface 78 be flat and tilted (from the vertical) by no more than about 30 degrees (more preferably no more than about 20 degrees; most preferably between about 10 to about 15 degrees).

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A cap for a container comprising:

a cap body including an upper portion and a lower portion, said lower portion defining a ring-positioning member; and a ring including an outer member disposed proximate an outside surface of said lower portion and selectively engaging said ring-positioning member, an inner member disposed proximate an inside surface of said lower portion with said ring positioning member being positioned inwardly of said outer member and outwardly of said inner member, so as to be located between said outer and inner members, said inner member having at least one tab extending inwardly and upwardly and terminating at a first edge, and at least one finger member protruding inwardly from said inner member and terminating at a second edge above said first edge of said tab.

2. A cap according to claim 1, wherein said ring-positioning member includes a groove for selectively receiving said outer member of said ring.

3. A cap according to claim 2, wherein said outer member includes an inwardly extending element for mating with said groove.

4. A cap according to claim 1, wherein said ring-positioning member includes a chamfer on a lower inside edge.

5. A cap according to claim 1, wherein said ring includes at least one frangible connection disposed between said inner member and said outer member.

6. A cap according to claim 5, wherein said frangible connection is broken by a vertical separation of said inner member from said outer member.

7. A cap according to claim 5, wherein said frangible connection is a generally triangular tab.

8. A cap according to claim 5, wherein a base of said frangible connection is secured to said outer member and an opposing apex of said frangible connection is secured to said inner member.

9. A cap according to claim 5, wherein said outer member of said ring remains engaged with said ring-positioning member after said frangible connection has been broken.

10. A cap according to claim 5, wherein said frangible connection provides an audible signal when said cap is removed indicating the presence of a previously untampered container.

11. A cap according to claim 5, said cap selectively connected to a container having a container neck, wherein said tab and said finger member arrest said inner member of said ring, said tab preventing said inner member from sliding up the container neck as and after said frangible connection is broken and said finger member preventing said inner member from sliding down the container neck after said frangible connection is broken.

12. A cap according to claim 1, wherein said finger member selectively engages a container neck having a groove adapted to receive said finger member, hindering said inner member of said ring from rotating around the container neck.

13. A cap according to claim 1, wherein an upper surface of said inner member selectively en gages said lower portion of said cap body.

14. A cap according to claim 1, wherein said tab secures the cap from backing-off during transit.

15. A cap according to claim 1, wherein a plurality of said tabs and fingers are disposed circumferentially around said inside portion of said ring in a pattern.

16. A cap according to claim 15, wherein said pattern in a first circumferential direction includes a larger tab, a first smaller tab, a space, and a second smaller tab.

17. A cap according to claim 16, wherein a frangible connection is disposed circumferentially between said fingers and said larger tab.

18. A cap according to claim 16, wherein a frangible connection is disposed between said first smaller tab and said second smaller tab.

19. A cap according to claim 1, wherein a plurality frangible connections are generally symmetrically spaced circumferentially around said ring.

20. A cap according to claim 1, wherein a plurality of finger members and tabs are generally symmetrically spaced circumferentially around said inner member.

21. A cap according to claim 1, wherein a plurality of tabs are disposed circumferentially between two finger members.

22. A cap according to claim 21, wherein a first tab with a first circumferential extent is proximate a first finger member and a second tab with a second circumferential extent is proximate a second finger member.

23. A cap according to claim 22, wherein a third tab with a third circumferential extent is proximate said second tab, said third circumferential extend is approximately equal to said first circumferential extent.

24. A cap according to claim 1, wherein said ring is formed with a specific color to generally indicate contents of said container.

25. A ring for a cap including an upper portion and a lower portion defining a ring-positioning member comprising:

an outer member configured to selectively engage the cap;

an inner member disposed radially inwardly of said outer member with the outer and inner members being configured to receive the ring-positioning member with the ring-positioning member being positioned inwardly of said outer member and outwardly of said inner member, so as to be located between said outer and inner members, said inner member having at least one tab extending inwardly and upwardly and terminating at a first edge; and at least one finger member protruding inwardly from said inner member and terminating at a second edge above said first edge of said tab.

26. A ring according to claim 25, wherein at least one frangible connection is disposed between said inner member and said outer member.

27. A ring according to claim 26, wherein said outer member of said ring remains engaged with the cap after said frangible connection has been broken.

28. A ring according to claim 26, wherein said frangible connection is broken by a vertical separation of said inner member from said outer member.

29. A ring according to claim 26, wherein said frangible connection is a generally triangular tab.

30. A ring according to claim 25, wherein a plurality frangible connections are generally symmetrically spaced circumferentially around said outer member.

31. A ring according to claim 25, wherein a plurality of finger members and tabs are generally symmetrically spaced circumferentially around said inner member.

32. A ring according to claim 25, wherein a plurality of said tabs are disposed circumferentially between two finger members.

33. A ring according to claim 25, wherein a first tab with a first circumferential extent is proximate a first finger member and a second tab with a second circumferential extent is proximate a second finger member.

34. A ring according to claim 33, wherein a third tab with a third circumferential extent is proximate said second tab, said third circumferential extend is approximately equal to said first circumferential extent.

35. A method of separating a cap with a ring from a container, the cap being in selective contact with a container neck of the container, comprising the steps of:

providing an outer member of said ring in selective contact with the cap;

securing an inner member of said ring to the container neck, said inner member having at least one tab and at least one finger member, said tab extending inwardly and upwardly and terminating at a first edge, said finger member protruding inwardly from said inner member and terminating at a second edge above said first edge of said tab;

connecting said outer member and said inner member using a frangible connection, said frangible connection being disposed between said inner member and said outer member; and twisting the cap and breaking said frangible connection with a vertical motion of the cap so that said inner member is retained by the container neck and said outer member is removed from the container neck with the cap.

36. A method according to claim 35, wherein said securing includes arresting said inner member of said ring by said finger member and said tab, said tab preventing said inner member from sliding up the container neck when said frangible connection is broken and said finger member preventing said inner member from sliding down the container neck when said frangible connection is broken.

37. A method according to claim 35, wherein said securing includes arresting said inner member of said ring to a transfer bead on the container neck, said first edge of said tab being in selective contact with a lower surface of the transfer bead, said second edge of said finger member being in selective contact with an upper surface of the transfer bead.

38. A cap for a container comprising:

a cap body including an upper portion and a lower portion, said lower portion defining a ring-positioning member; and a ring including an outer member disposed proximate an outside surface of said lower portion selectively engaging said ring-positioning member, an inner member disposed proximate an inside surface of said lower portion with said ring-positioning member being positioned inwardly of said outer member and outwardly of said inner member, said inner member having a plurality of inwardly and upwardly extending projections, and a plurality of frangible connections being disposed between said outer member and said inner member.

39. A cap according to claim 38, wherein said frangible connections are broken by a vertical separation of said inner member from said outer member.

40. A cap according to claim 38, wherein said frangible connections are generally triangular.

41. A cap according to claim 38, wherein said frangible connections are generally symmetrically spaced circumferentially around said outer member.

* * * * *

UNITED STATES PATENT AND TRADEMARK OFFICE

CERTIFICATE OF CORRECTION

Figure 9:
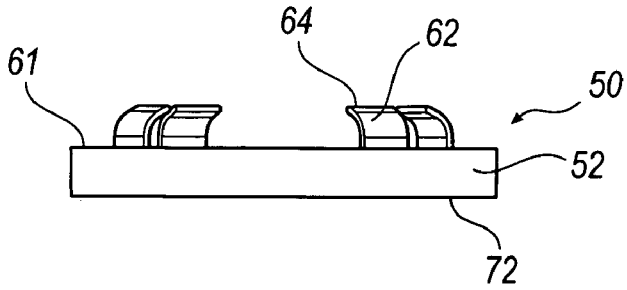
FIG. 9 is side view of the closure ring of FIG. 7.
Figure 10:
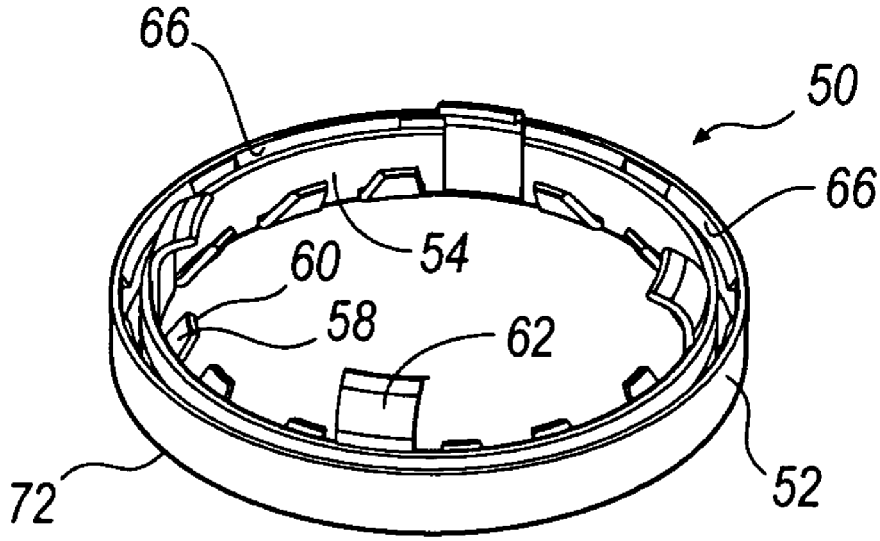
FIG. 10 is a top perspective view of the closure ring of FIG. 7.
Figure 11:
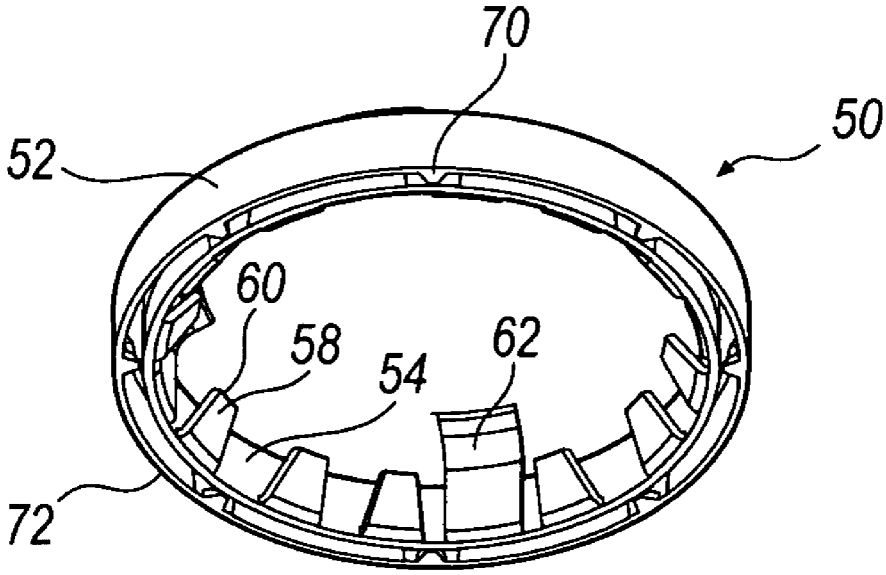
FIG. 11 is a bottom perspective view of the closure ring of FIG. 7.

PATENT NO. : 7,527,161 B2
APPLICATION NO. : 11/001279
DATED : May 5, 2009
INVENTOR(S) : Jack Rodriguez It is certified that error appears in the above-identified patent and that said Letters Patent is hereby corrected as shown below:

In column 2, line 35, change "FIG. 9 is side view" to --FIG. 9 is a side view--.

In column 5, line 21, change "Inner member 54 as shown secured in place" to --Inner member 54 is shown secured in place--.

In column 7, line 1, change "would be very similarly to the upper portion" to --would be very similar to the upper portion--.

In column 7, line 57, change "When the frangible connection 70 are broken," to --When the frangible connections 70 are broken,--.

In claim 13, column 9, line 30, change "selectively en gages said lower portion" to --selectively engages said lower portion--, as appears in the Amendment dated April 2, 2008 at Page 4, claim 13.

In claim 19, column 9, line 46, change "wherein a plurality frangible connections" to --wherein a plurality of frangible connections--.

In claim 30, column 10, line 24, change "wherein a plurality frangible connections" to --wherein a plurality of frangible connections--.

Signed and Sealed this

Sixteenth Day of March, 2010

David J. Kappos

David J. Kappos
*Director of the United States Patent and Trademark Office*